United States Patent [19]

Sato et al.

[11] Patent Number: 4,834,272

[45] Date of Patent: May 30, 1989

[54] SIDE-POURING APPARATUS

[75] Inventors: Jiro Sato, Aichi; Kenitsu Yoshida, Nagoya, both of Japan

[73] Assignee: Fujiwa Kiko Kabushiki Kaisha, Nagoya, Japan

[21] Appl. No.: 135,171

[22] Filed: Dec. 18, 1987

[30] Foreign Application Priority Data

Dec. 27, 1986 [JP] Japan ..... 61-310681
Aug. 10, 1987 [JP] Japan ..... 62-199461

[51] Int. Cl.[4] ..... C21C 7/00
[52] U.S. Cl. ..... 222/604; 266/236; 266/275
[58] Field of Search ..... 266/236, 44, 275, 276; 222/604, 605

[56] References Cited

U.S. PATENT DOCUMENTS 2,406,147 8/1946 Hopkins ..... 266/236
3,940,021 2/1976 Sillen et al. ..... 222/604
4,684,109 8/1987 Archenholtz et al. ..... 266/236

*Primary Examiner*—Scott Kastler, III
*Attorney, Agent, or Firm*—Seidel, Gonda, Lavorgna & Monaco

[57] ABSTRACT

A side-pouring apparatus comprising a ladle tiltable about an axis of rotation and drive means for tilting said ladle, said ladle including molten-metal receptacle space, a molten-metal guide passage in communication with and extending sidewise from said molten-metal receptacle space, and a pouring spout in communication with said molten-metal guide passage and normal to said axis of rotation, said guide passage having a surface that forms a portion of said spout, said surface being curved so that the center of curvature of said surface substantially coincides with said axis of rotation.

6 Claims, 10 Drawing Sheets

SIDE-POURING APPARATUS

DETAILED DESCRIPTION OF THE INVENTION

1. Industrial Field of the Invention

This invention relates to a side-pouring apparatus for successively pouring molten metal from a ladle into molds made in succession by a molding machine.

2. Prior Arts

Various pouring units of tilting type have hitherto been suggested or introduced to facilitate efficient manufacture of castings by automatic pouring systems which successively pour molten metal from a ladle into molds made, in succession, by a molding equipment. With molds having a pouring cup distant from the pouring point, either a molten-metal guide is provided midway or a side-pouring apparatus having a pouring spout formed on a side is used.

A typical ladle 1 for use with such a side-pouring apparatus, as shown in FIG. 10, is fan-shaped in vertical section. The pivot of the fan corresponds to the axis of rotation O of the ladle, and a U-shaped pouring spout P is formed, as in FIG. 11, on a side of the ladle along the axis of rotation O. The side-pouring apparatus of this character forces molten metal in the ladle toward the pouring spout P by tilting its ladle and thereby pouring the molten metal into molds. However, because the contour of the pouring spout P varies as the ladle tilts gradually with a corresponding change in the pouring streamline from the spout P to the pouring cup of the mold, it has been necessary to finely adjust the position of the pouring apparatus simultaneously with the tilting of the ladle or, alternatively, to make molds with an enlarged pouring cup. Moreover, the inability of smoothly and positively cutting off the pouring when desired has been deemed a fundamental disadvantage of the pouring apparatus of the construction described above. Many different spout configurations and ladle tilting techniques have been proposed, but none appear to have proved satisfactory with practical value.

Generally, to carry on pouring without interrupting a continuous molding line operation it is customary to use two units of pouring apparatus alternately, one for pouring while the other is being filled with the molten metal. Where two such units are employed along the molding line and where the width of the molds are considerably large, effort is made to minimize the number of intermediate molds that cannot be poured. For instance, the two units equipped, respectively, with ladles 1*a*, 1*b* of symmetric structure as shown in FIG. 12 are installed adjacent to each other, with molten-metal guides G attached, if necessary, to the pouring side. Alternatively, as in FIG. 13, the pouring units are tilted to a predetermined angle to the molding line. With these pouring arrangements it has been impossible or extremely difficult to allow the streams of molten metal from the two pouring units to fall onto one and the same point, or to a single pouring cup of a mold. Neither method permits pouring especially where the width of the molds are narrow or in the case of an automatic pouring system including a high-speed molding line that requires large pouring apparatus with ladles of large capacity.

Our experiments have revealed that, when two molds spaced apart are to be poured in succession, the mold located next to the filled mold is intensely affected with heat from the preceding mold. The heat can cause rapid changes in the molding sand, resulting in distortions of surrounding wall of the mold cavity and a large possibility of giving defective castings. This is particularly true of small-size molds as in FIG. 13. The only solution to the problem is abandoning the mold in question at a sacrifice of casting efficiency. It has now been found that this problem in high-speed molding line operation is overcome by providing an arrangement in which two pouring units can pour one and the same mold at the same pouring point, the arrangement being most advantageously applicable to a molding line operated in high-speed tact motion. The present invention is predicated upon this newly found fact.

The present invention has for its object the provision of a side-pouring apparatus capable of continuously pouring molten metal at one and the same pouring point without varying the streamline of molten metal from the spout of a ladle to the pouring cup of each mold, the apparatus being particularly useful for the molding line in high-speed tact motion.

Another object of the invention is to provide a side-pouring apparatus of high casting efficiency capable of pouring molten metal, in an arrangement of at least two pouring units on a molding line of high-speed tact motion, into molds at one and the same point.

Another object of the invention is to provide a side-pouring apparatus which, when the ladle has been tilted to pour the molten metal from the ladle into molds, can always pour the metal under constant conditions (velocity, quantity, time, etc.) into the molds.

Still another object of the invention is to provide a side-pouring apparatus capable of smoothly and positively cutting off the pouring of molten metal whenever desired during the pouring from the ladle into the molds.

Yet another object of the invention is to provide a side-pouring apparatus including a ladle which can be easily detached.

SUMMARY OF THE INVENTION

The above objects are realized by a side-pouring apparatus of the invention. Briefly, the invention resides in a side-pouring apparatus characterized by a fan-shaped ladle tiltable around an axis of rotation and drive means for driving the fan-shaped ladle, said fan-shaped ladle including a molten-metal receptacle space with a sectional contour normal to the axis of rotation being fan-shaped with respect to the axis of rotation, a molten-metal guide passage formed in communication with the molten-metal receptacle space and extended sidewise, and a pouring spout formed in communication with the molten-metal guide passage and in the direction normal to the axis of rotation, with the bottom of the molten-metal guide that forms the pouring spout being formed so that the center of curvature of the bottom coincides with the axis of rotation.

DETAILED DESCRIPTION OF THE PREFERRED EMBODIMENTS

Now the side-pouring apparatus according to the present invention will be described in more detail with reference to the drawings.

Figure 1:
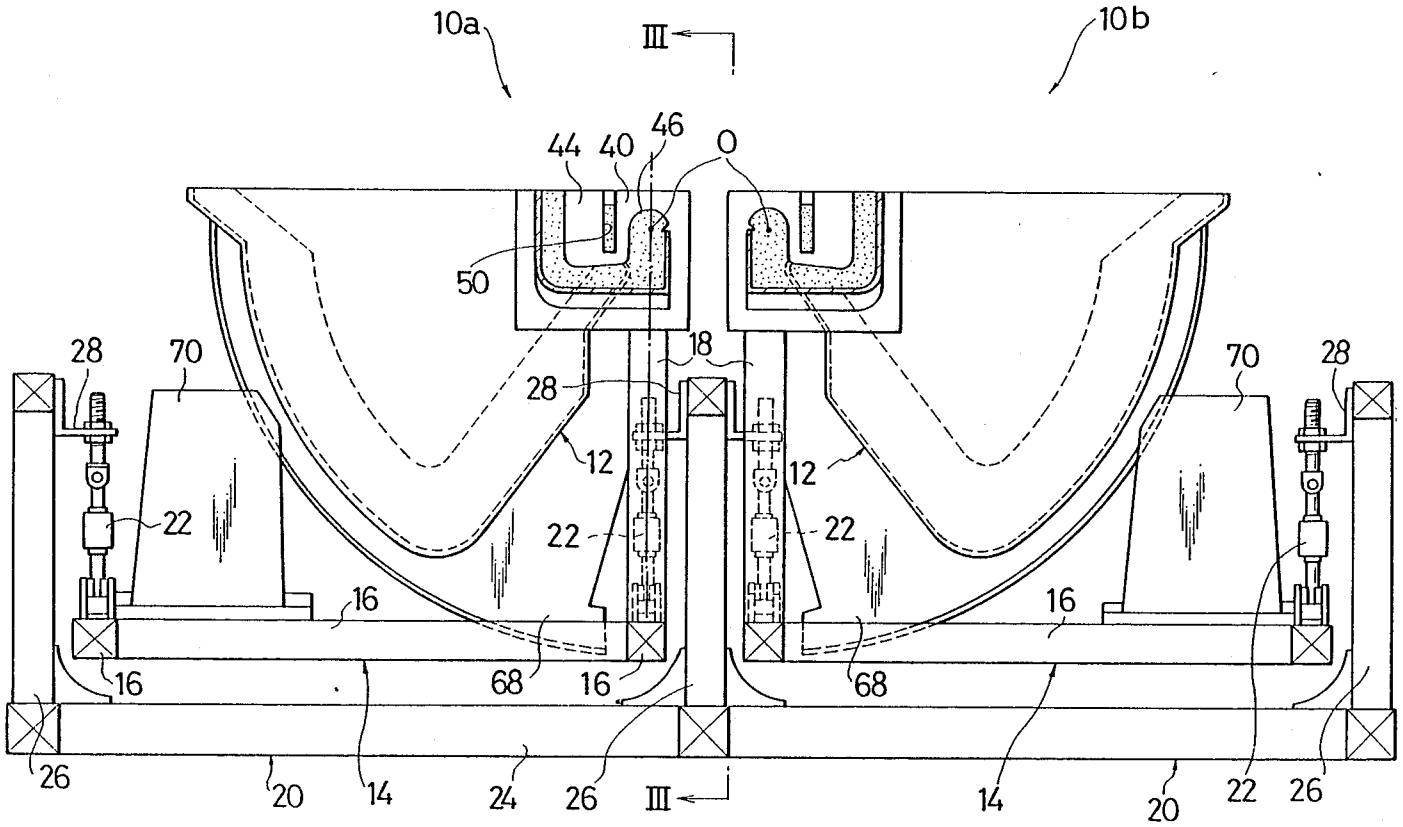
FIG. 1 is a front elevational view of a side-pouring apparatus in a two-unit arrangement according to the invention, with molten-metal guide passage means shown in section taken on the line I—I of FIG. 2.
Figure 2:
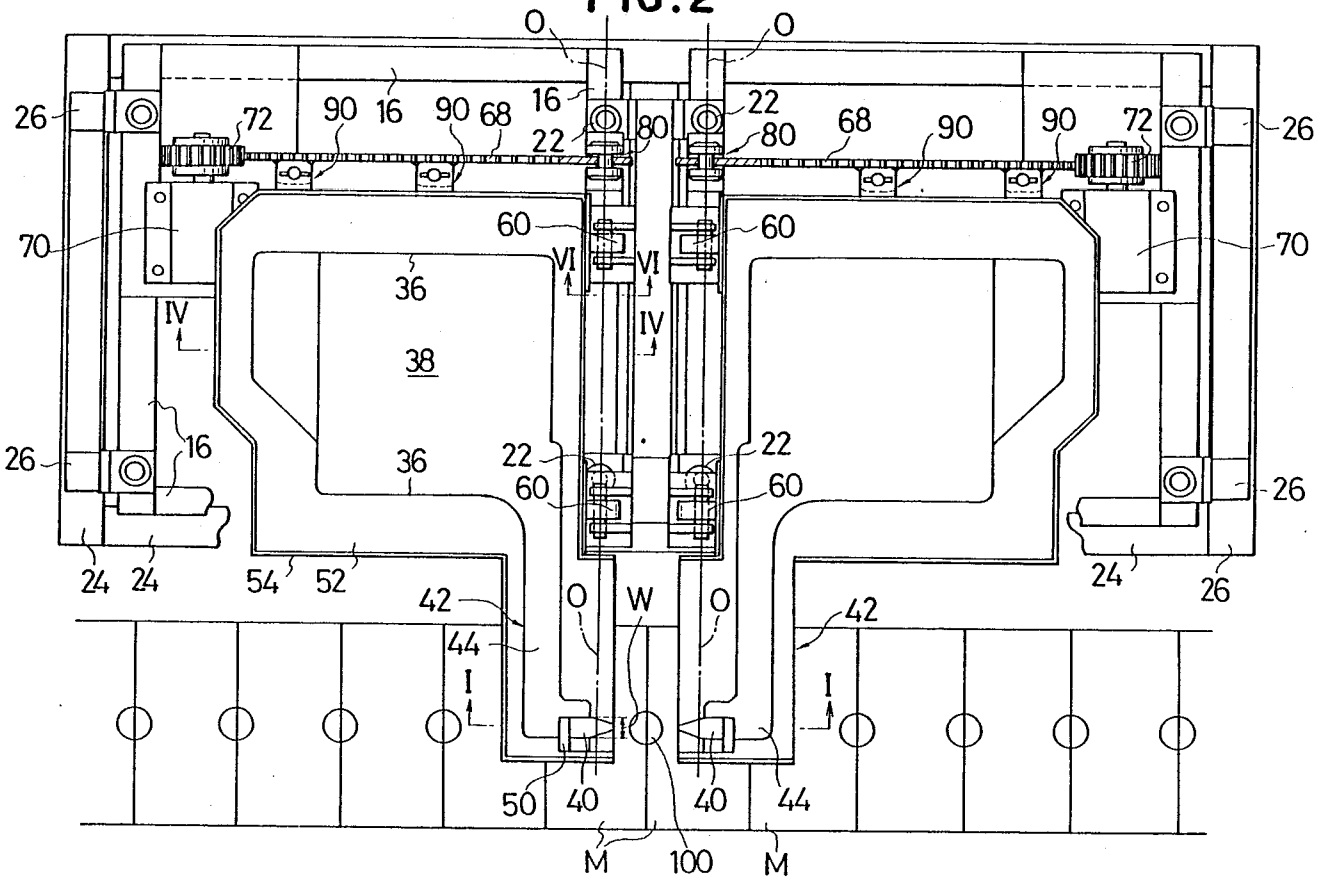
FIG. 2 is a plan view of the side-pouring apparatus of FIG. 1.
Figure 3:
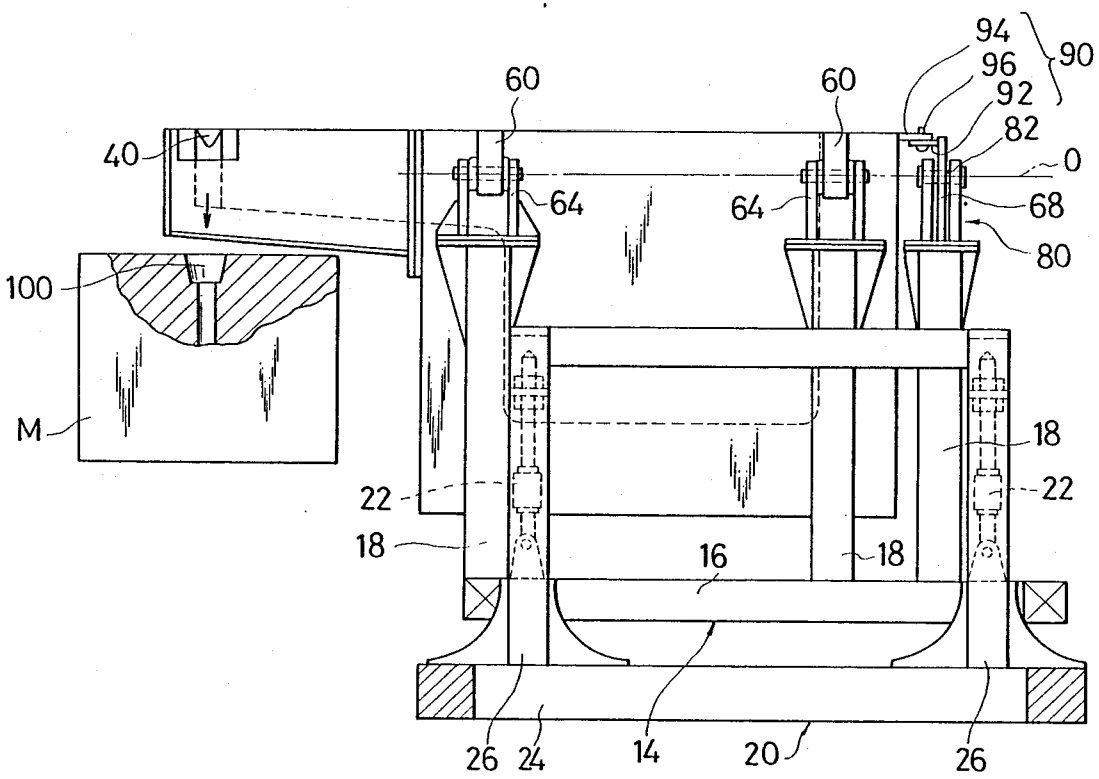
FIG. 3 is a sectional view taken on the line III—III of FIG. 1.

FIGS. 1 to 3 illustrate an automatic pouring system comprising two units (10*a*, 10*b*) of a side-pouring apparatus 10 embodying the invention arranged along a molding line. The two pouring units 10*a*, 10*b*, disposed in a mirror-image relation, are substantially the same in construction.

As the pouring units 10*a*, 10*b* are constructed almost identically, the following description of the construction will be made mostly in connection with the unit 10*a*. The pouring unit 10*a* includes a ladle 12 to be described in detail later, which ladle 12 is mounted on an inner frame 14 which surrounds the vessel. To be more specific, the inner frame 14 in the embodiment being described is a framework consisting of rectangularly assembled horizontal frame members 16 and vertical frame members 18 extending vertically upward and fixed to the horizontal members 16.

The inner frame 14 is suspended within an outer frame 20 through load cells 22. More particularly, the outer frame 20 in this embodiment is a framework comprising horizontal frame members 24 fitted together, for example, on a truck or the like adapted to move on a track, and four vertical frame members 26 extending vertically upward from the horizontal frame members 24. The inner frame 14 is suspended by the outer frame 20 with tension type load cells 22. Each cell 22 is disposed between a bracket 28 secured to one of the vertical frame members 26 and a horizontal frame member 16 of the inner frame 14.

Next, the construction of the ladle 12 built in accordance with the present invention will be described.

Figure 4:
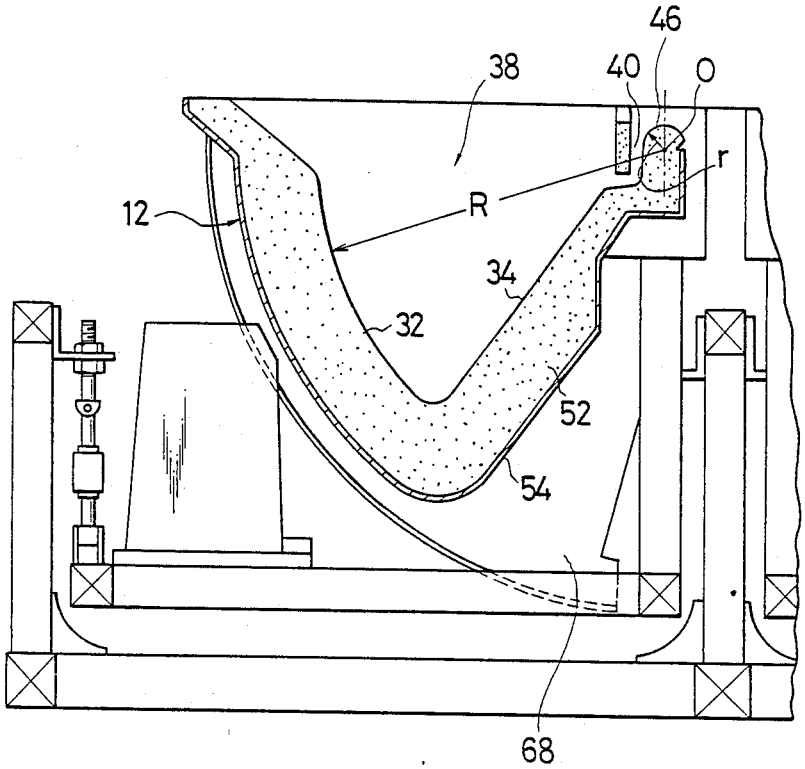
FIG. 4 is a sectional view taken on the line IV—IV of FIG. 2.

The ladle 12 is a fan-shaped one with a segmental cross sectional contour. As indicated in FIGS. 2 and 4, it has an axis of rotation O extending perpendicularly to the drawings. It comprises a molten-metal receptacle space 38 capable of holding a predetermined quantity of molten metal, defined by a bottom wall 32 of an arcuate contour with a radius R from the axis of rotation O, a front wall 34 contiguous to the bottom wall 32, and both side walls 36 formed along the both side edges of the bottom and front walls 32, 34. According to this invention, as best shown in FIG. 2, a pouring spout 40 is formed in a molten-metal guide passage means 42 projecting vertically outward from one side wall 36. In the molten-metal guide passage means 42 is formed a molten-metal guide passage 44 establishing communication between the pouring spout 40 and the molten-metal receptacle space 38. The spout 40 is provided at right angles to the molten-metal guide passage 44 and has a width W. The bottom wall of the pouring spout, or the molten-metal guide bottom 46, which guides the molten metal leaving the spout 40 is desired to be arcuately shaped with a radius r or curved short of an arc to ensure smooth, positive stopping of pouring. The center of radius r or of curvature coincides with the axis of rotation O of the ladle. In the embodiment under consideration, a weir 50 is provided between the molten-metal guide passage 44 and the pouring spout 40 to keep the slag and the like produced in the receptacle space 38 from flowing out of the spout 40 into a mold.

The walls 32, 34, 36, molten-metal guide passage 44, pouring spout 40, weir 50, and other associated portions of the ladle 12 that come in contact with the molten metal are formed of refractory material 52, which in turn is covered by an outer wall or shell 54 of steel plate or the like.

Figure 6:
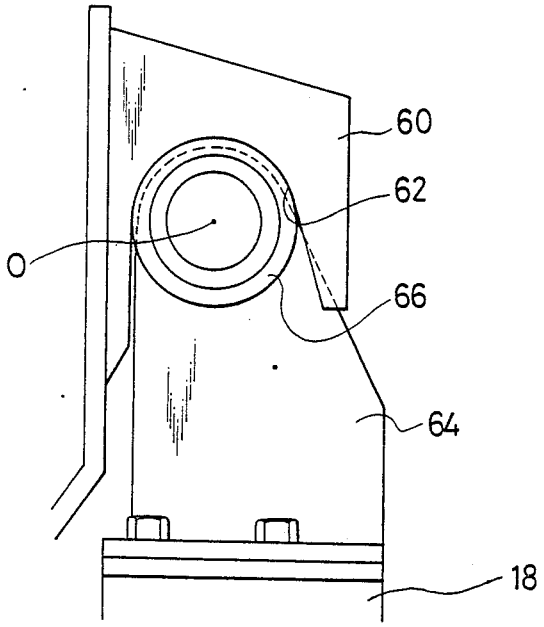
FIG. 6 is a sectional view taken on the line VI—VI of FIG. 2.

As can be seen from FIGS. 2, 3, and 6, generally inverted-U-shaped bearing members 60, open at the bottom, are fixed to the outer side of the front wall 34 of the ladle 12. Each bearing member 60 has a bearing hole 62 open at the bottom with which to rest on a roll 66 of a bearing roll means 64 secured to a vertical frame member 18 of the inner frame 14. The bearing hole 62 and the roll 66 are both made so that their centers of rotation coincides with the axis of rotation O of the ladle.

Figure 5:
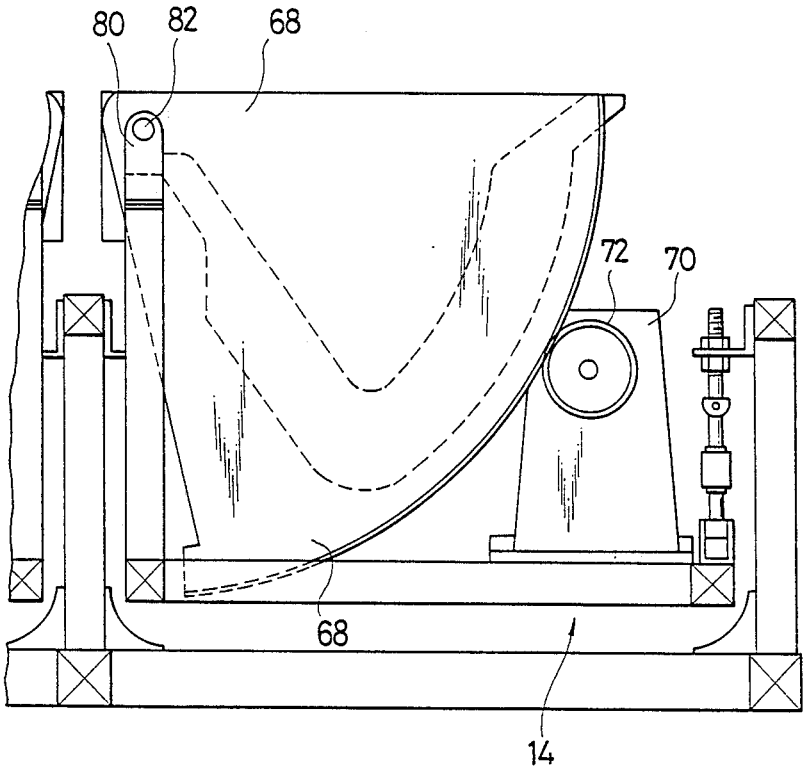
FIG. 5 is a back view of the side-pouring apparatus of FIG. 1, with the right-hand ladle omitted.

In this embodiment a sector wheel 68 is located adjacent the side wall of the ladle opposite to the side where the molten-metal guide passage means 42 is provided. The center portion for rotation (or the pivot of the fan shape) of the sector wheel 68 is rotatably connected to a pin 82 of a support means 80 provided on a vertical frame member 18 of the inner frame 14. Needless to say, the sector wheel 68 is so built that its center of rotation coincides with the axis of rotation 0 of the ladle. The teeth of the sector wheel 68 are in mesh with those of an output wheel 72 of a drive means 70 which drives the ladle in its tilting motion (FIG. 5). The drive means 70 in this embodiment is mounted on the inner frame 14.

In the construction so far described, the ladle 12 is detachably carried by the sector wheel 68 by connector means 90 while, at the same time, it rests turnably on the support roll means 64 with the bearing members 60 attached to the front of the ladle. To be more exact, as will be clear from FIGS. 2 and 3, each connector means 90 comprises a bracket 92 fixed to the sector wheel 68 and a mounting plate 94 secured to a side of the ladle 12 and adapted to engage the bracket 92. Thus, the ladle 12 is supported rotatably by the support roll means 64 since, as described above, the bearing members 60 are turnably supported by the support roll means 64 and the mounting plates 94 are carried by the brackets 92 of the sector wheel 68. To ensure the engagement of each mounting plate 94 with the bracket 92, a fastener pin 96 may be inserted through holes formed in the both plates. With the foregoing construction, the ladle 12 is carried by the inner frame 14 and is tilted with respect to the support roll means 64 as the sector wheel 68 is driven by the output wheel 72 of the drive means 70. It should be obvious to those skilled in the art that controls (not shown) and other associated components for the drive means 70 are also mounted on the inner frame 14.

Although the pouring apparatus of the invention has thus far been described in connection with the left-head unit 10*a* shown in FIG. 1, the same applies to the right-hand unit 10*b* as well. Since the two units are identically built and arranged in mirror-image fashion, like parts are given like reference numbers and the explanation is not repeated.

The operation of the pouring units 10*a*, 10*b* constructed as above will now be explained. The two units 10*a*, 10*b* are arranged so that their front faces, or pouring spouts 40, are opposed to each other along the molding line. In other words, as shown in FIG. 2, the pouring spouts 40 of the ladles 12 are located on both sides of the pouring cup 100 of a mold M to be filled. The ladles 12 hold a predetermined quantity of molten metal each.

Then, the drive means 64 of either pouring unit is started to produce a rotational force, which is transmitted from the output wheel 72 to the sector wheel 68, with the result that the ladle 12 involved is tilted with respect to the axis of rotation O. The molten metal in the ladle flows through the molten-metal guide passage 44 in the vessel and thence through the spout 40 into the pouring cup 100 of the mold M. The bottom wall 46 of the pouring spout 40 is arcuately or likewise shaped to a curved contour, and the relative positions of the spout 40 and the pouring cup 100 of the mold M remain substantially unchanged by the tilting of the ladle 12. Consequently, as the ladle 12 is tilted at a constant velocity, the molten metal can always be most satisfactorily poured into the pouring cup 100 of the mold M without the possibility of the pouring streamline of the molten metal from the spout 40 to the cup 100 being varied by the tilting of the ladle. Even more desirable pouring can be performed by following the procedure described in the published specification of Patent Application Publication No. 9580/1977 filed by the present applicant, that is, by rotating and tilting the ladle 12 at a velocity of $V\theta_1$ until pouring, at a velocity of $V\theta_2$ ($V\theta_2 < V\theta_1$) during pouring, and tilting it back at a given velocity after the pouring.

Following the conclusion of pouring by one ladle 12, the other ladle 12 begins working. Meanwhile, the ladle that has emptied is refilled with the molten metal.

In the above-mentioned embodiment, the shape of the ladle has been described as fan-shaped , however, the present invention will not be limited to the fan-shape and can be embodied in another shape. In such a case, the tilting speed of the ladle may be controlled so as to pour the molten metal from the ladle into molds under constant conditions.

Although an arrangement of two side-pouring units has been described above, it is possible to operate either apparatus alone depending upon the use. Also, while the ladle 12 has been explained as detachably mounted on the inner frame 14, this is not a limitation; instead, it may be fixed to the frame.

Now, another embodiment to which the principle of the present invention is applied will be described with reference to FIG. 7, FIG. 8 and FIG. 9.

This other embodiment is generally similar to the aforementioned embodiment, but slightly different from the same in the points of the tilting mechanism of the ladle, the shape of the ladle and the mounting of the ladle on a truck.

Further, in this embodiment, like elements are given like reference characters.

Figure 7:
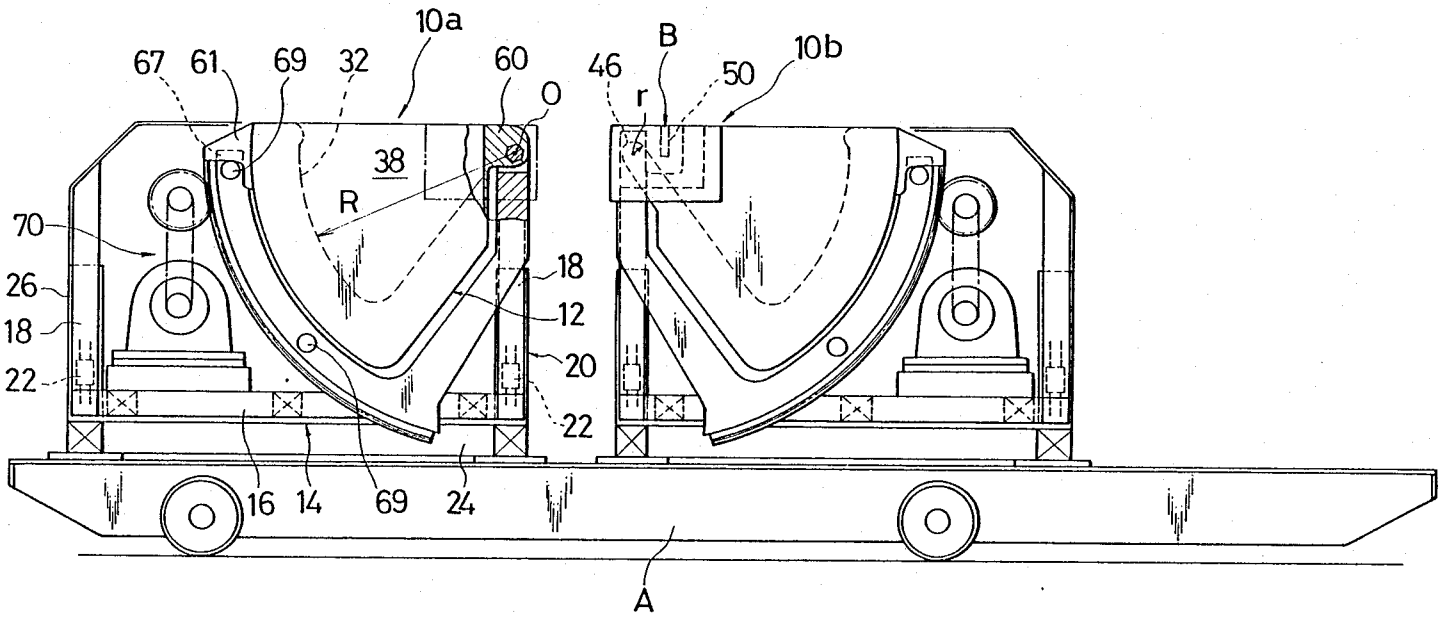
FIG. 7 is a diagrammatic front view of another embodiment of a side-pouring apparatus in a two-unit arrangement according to the invention.
Figure 8:
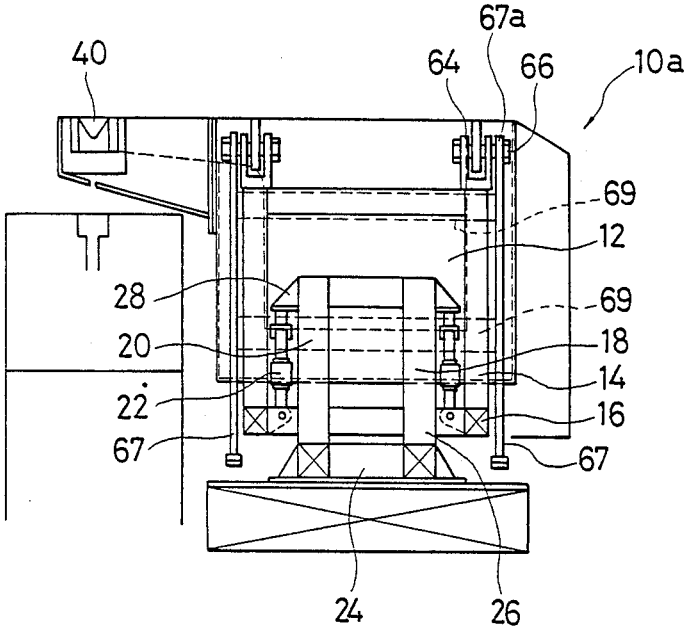
FIG. 8 is a diagrammatic side view in part of the side pouring apparatus of FIG. 7.
Figure 9:
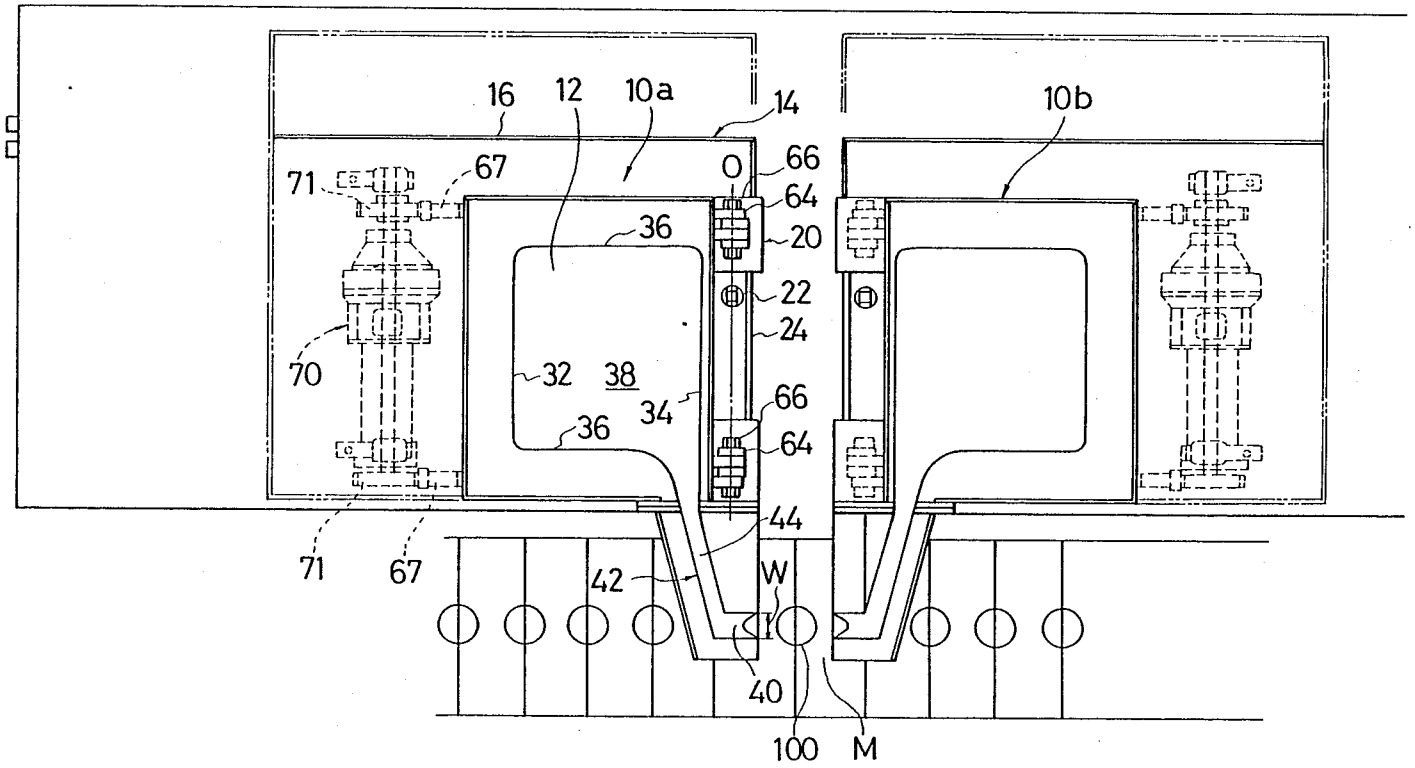
FIG. 9 is a diagrammatic plan view of the side-pouring apparatus of FIG. 7.
Figure 10:
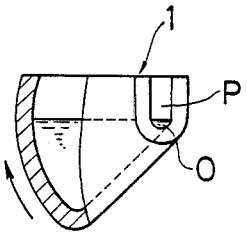
FIG. 10 PRIOR ART
FIG. 10 is a fragmentary sectional view of the ladle of a conventional side-pouring apparatus.
Figure 11:
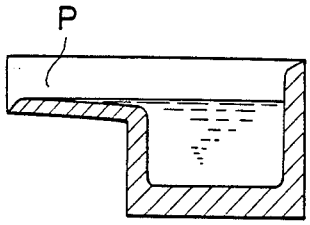
FIG. 11 PRIOR ART
FIG. 11 is a vertical sectional view of the ladle of the side-pouring apparatus shown in FIG. 10.
Figure 12:
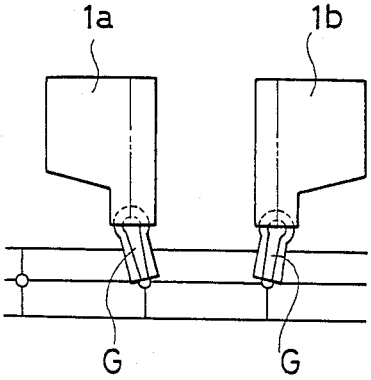
FIG. 12 PRIOR ART
FIGS. 12 and 13 are plan views of arrangements using two units of conventional side-pouring apparatus.
Figure 13:
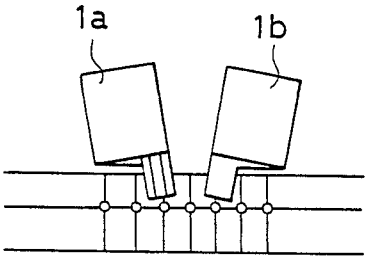
FIG. 13 PRIOR ART

FIGS. 7 to 9 illustrate an automatic pouring system comprising two units (10*a*, 10*b*) of another side-pouring apparatus 10 embodying the invention arranged along a molding line. The two pouring units 10*a*, 10*b*, disposed in a mirror-image relation, are substantially the same in construction. The following description of the construction will, therefore, be made mostly in connection with the unit 10*a*.

The pouring unit 10*a* includes a ladle 12 to be described in detail later, which ladle 12 is mounted on an inner frame 14. The inner frame 14 in the embodiment being described is a framework consisting of rectangularly assembled horizontal frame members 16 and vertical frame members 18 extending vertically upward and fixed to the horizontal members 16.

The inner frame 14 is suspended within an outer frame 20 through load cells 22. The outer frame 20 in this embodiment is built as a framework comprising horizontal frame members 24 fitted together, for example, on a truck A or the like adapted to move on a track, and four vertical frame members 26 extending vertically upward from the horizontal frame members 24. The inner frame 14 is suspended by the outer frame 20 with tension type load cells 22. Each cell 22 is disposed between a bracket 28 secured to one of the vertical frame members 26 and a horizontal frame member 16 of the inner frame 14.

Next, the construction of the ladle 12 built in accordance with the present invention will be described.

The ladle 12 is a fan-shaped one with a segmental cross sectional contour. As can be seen from FIGS. 7 and 9, it has an axis of rotational support O extending perpendicularly to FIG. 7 (the side of the ladle having the axis of rotational support is herein referred to as one end of the ladle and the side opposite to the axis as the other end, in this embodiment). It comprises a molten-metal receptacle space 38 capable of holding a predetermined quantity of molten metal, defined by a bottom wall 32 of an arcuate contour with a radius R from the axis of rotational support O, a front wall 34 contiguous to the bottom wall 32, and both side walls 36 formed along the both side edges of the bottom and front walls 32, 34. According to this embodiment, as best shown in FIGS. 8 and 9, a pouring spout 40 is formed in a molten-metal guide passage means 42 projecting vertically outward from one side wall 36. In the molten-metal guide passage means 42 is formed a molten-metal guide passage 44 establishing communication between the pouring spout 40 and the molten-metal receptacle space 38. The spout 40 is provided at right angles to the molten-metal guide passage 44 and has a width W. The bottom wall of the pouring spout 40, or the molten-metal guide bottom 46, which guides the molten-metal leaving the spout 40 is desired to be arcuately shaped with a radius r or curved short of an arc to ensure smooth, positive stopping of pouring. (Refer to FIG. 1B.) The center of radius r or of curvature coincides with the axis of rotational support O of the ladle. In the embodiment under consideration, a weir 50 may sometimes be provided between the molten-metal guide passage 44 and the pouring spout 40 to keep the slag and the like produced in the receptacle space 38 from flowing out of the spout 40 into a mold.

The walls 32, 34, 36, molten-metal guide passage 44, pouring spout 40, weir 50, and other associated portions of the ladle 12 that come in contact with the molten-metal are formed of refractory material, which in turn is covered by an outer wall or shell of steel plate or the like.

As will be understood by reference to FIGS. 7 to 9, generally inverted-U-shaped bracket members 60, open at the bottom, are fixed to the outer edges of the front wall 34 at one end of the ladle 12. Each bracket member 60 has a bracket hole 62 open at the bottom with which to rest on a bearing 66 of a support bearing means 64 secured to a vertical frame member 18 of the inner frame 14. Thus, the ladle 12 is turnably supported at one end by the inner frame 14. The bracket hole 62 and the bearing 66 are both made so that their centers of rotation coincides with the axis of rotational support 0 of the ladle 12.

Below or alongside the ladle 12, and in such a manner as to follow the contour of the ladle, there are provided supports 67 to support the ladle 12 with a given clearance between each support and the ladle. In this embodiment, the supports 67 are disposed in a pair on the outer periphery, or the both edges of the lower side, of the ladle 12. These supports 67 on both edges of the lower side of the ladle 12 are connected to each other by at least one connector 69, so that they are under mutual constraint and are integrally tilted forward or backward along the same locus by the driving force of drive means 70 to be described below.

On the outer side of the supports 67 is installed a gearing as power transmitting means necessary for tilting the ladle 12. The gearing is adapted to engage a driving gear 71, which is connected, for example, by an endless chain to an output gear 72 of drive means 70 such as a motor mounted on the inner frame 14, whereby the driving force from the drive means 70 is transmitted to the gearing of the supports 67. In the embodiment being described the supports 67 are engaged, one for each, with the drive gears 71 located on both sides of one motor. The ladle 12 is supported at both sides of the outer bottom by the supports 67, at two symmetric points with respect to the center of the ladle. Thus, the ladle 12 is integral with the supports 67 and they are tilted altogether by the power transmitted from the output gears. The rotational center or pivotal part 67*a* of each support 67 on the front, or one end, of the ladle 12 rotatably rests on the bearing 66 of the support bearing means 64 on top of a vertical frame member 18 of the inner frame 14. The rotational center of the support 67, of course, is formed to coincide with the axis of rotational support O0 of the ladle 12.

The ladle 12 rests turnably, as described above, with the bracket members 60 provided at the front or one end of the ladle in engagement with the bearings 66 of the support bearing means 64. At the same time, a member 61 at the rear side on the other end of the ladle 12 rests on the upper connector 69 that extends between the supports 67 to connect them.

As stated before, the gearing provided behind the supports 67 (on the other end) is supported by the driving gears 71. In this way the ladle 12 is made integral with the supports 67.

With the foregoing construction, the ladle 12 is, after all, carried together with the drive means by the inner frame 14 and is tilted around the bearings 66 of the support bearing means 64 as the supports 67 are driven by the driving gears 71 through the output wheel 72 of the drive means 70. It should be obvious to those skilled in the art that controls (not shown) and other associated components for the drive means 70 are also mounted on the inner frame 14.

Although the pouring apparatus of the invention has thus far been described in connection with the left-hand unit 10*a* shown in FIG. 7, the same applies to the right-hand unit 10*b* as well. Since the two units are identically built and arranged in mirror-image fashion, like parts are given like reference numbers and the explanation is not repeated.

In the embodiment described, the operation of the pouring units 10*a*, 10*b* is as follows. The two units 10*a*, 10*b* are arranged so that their front faces, or pouring spouts 40, are opposed to each other along the molding line. In other words, as shown in FIG. 9, the pouring spouts 40 of the ladles 12 holding a predetermined quantity of molten metal each are located on both sides of the pouring cup 100 of a mold M to be filled which is located distant from the ladles 12.

Then, the drive means 70 of either pouring unit is started to produce a rotational force, which is transmitted from the driving gears 71 to the gearing of the supports 67, with the result that the ladle 12 involved is tilted with respect to the axis of rotational support O. The molten-metal in the ladle 12 flows through the molten-metal guide passage 44 in the vessel and thence through the spout 40 into the pouring cup 100 of the mold M. The bottom wall 46 of the pouring spout 40 is arcuately or likewise shaped to a curved contour, and the ladle 12 is fan-shaped with the pivot as the center of rotation. The relative positions of the spout 40 and the pouring cup 100 of the mold M, therefore, remain substantially unchanged by the tilting of the ladle 12. Hence, as the ladle 12 is tilted at a constant velocity, the molten metal can always be most satisfactorily poured into the pouring cup 100 of the mold M in steady conditions (pouring velocity, quantity, time, etc.) without the possibility of the pouring streamline of the molten-metal from the spout 40 to the cup 100 being varied by the tilting of the ladle and also with smooth, positive cut-off of the pouring when desired. Even more satisfactory pouring can be performed by following the procedure described in the published specification of Patent Application Publication No. 9580/1977 filed by the present applicant, that is, by rotating and tilting the ladle 12 at a velocity of $V\theta_1$ until pouring, at a velocity of $V\theta_2$ ($V\theta_2 < V\theta_1$) during pouring, and tilting it back at a given velocity after the pouring.

After a mold has been filled by one ladle 12, the other ladle 12 begins working. Meanwhile, the ladle that has emptied is refilled with the molten metal, and the above cycle is repeated.

Thus, when the ladle 12 is to be tilted around the axis of rotational support to pour the molten metal into the mold, the supports 67 provided on both sides of the lower part of the ladle 12 are inclined by the driving force from the drive means 70. The ladle 12 is consequently tilted with the axis of rotational support as its center of rotation, in a state double-supported symmetrically at two points by the supports 67. The arrangement is most desirable for the safety of the usually dangerous pouring operation, because the ladle 12 can be stably tilted without subjection to any unbalanced load.

As described above, the ladle 12 is tilted with the axis of rotational support as its center of rotation and in a double-supported state, or as symmetrically supported at both left and right sides of the supports 67. The rotational support mechanism, or tiltable support mechanism, for the ladle 12 according to the invention thus requires less rigidity than does ordinary cantilever type or single-supporting mechanism and therefore can be simpler in construction.

Since the ladle 12 is made detachable from the inner frame 14, it is much easier to maintain than conventional ladles, with greater case of replacement and repairs of refractories on the side walls and other parts of the ladle 12.

The supports 67 are so disposed that each support contacts the ladle 12 only at the front and rear supporting points on one and the other ends of the vessel, with the rest of the support spaced a predetermined distance from the outer bottom of the ladle. The construction of the supports and the spacing minimize the conduction of the heat of molten metal in the ladle to the supports 67, preventing their thermal deformation.

ADVANTAGEOUS EFFECTS OF THE INVENTION

As described above, the side-pouring apparatus of the foregoing construction according to the present invention offers the following advantages. It is capable of pouring molten-metal in constant, stable conditions into a mold without varying the streamline of molten-metal from the pouring spout of th ladle to the pouring cup of the mold, and can cut off the pouring any time smoothly and positively. Even where two units are installed along the molding line, the molten-metal can be poured into molds, in succession, at one and the same pouring point. The arrangement is particularly advantageous when adopted in a molding line in high speed tact motion.

The ladle is double-supported at two end points by supports, and therefore it can be stably tilted without being subjected to any unbalanced load. The tiltable supporting mechanism need not be as rigid as conventional ones and can be simpler in construction. Moreover, the ladle is made detachable from the apparatus, rendering it extremely easy to make repairs and other maintenance that become necessary due to the ladle operation.

What is claimed is:

1. A side-pouring apparatus comprising a ladle tiltable about an axis of rotation and drive means for tilting said ladle, said ladle including a molten-metal receptacle space, a molten-metal guide in communication with and extending sidewise from said molten-metal receptacle space, and a pouring spout in communication with said molten-metal guide passage and normal to said axis of rotation, said guide passage having a surface that forms a portion of said spout, said surface being curved so that the center of curvature of said surface substantially coincides with said axis of rotation.

2. A side-pouring apparatus according to claim 1, further comprising a support interconnecting said ladle and said drive means and being tiltable with said ladle about a center of tilting which coincides with said axis of rotation and means for transmitting tilting forces between said drive means and said support.

3. A side-pouring apparatus according to claim 2, further comprising a bearing member located on said axis of rotation, said ladle being detachably mounted to said bearing member and a connector detachably interconnecting said support and said ladle.

4. A side-pouring apparatus according to claim 3, wherein said support comprises two supports, a first end of each said support being connected to said bearing member, and a second and of each said support being attached to said ladle via said connector.

5. A side-pouring apparatus according to claim 4, wherein each said support is spaced from the outer periphery of the ladle a distance sufficient to minimize the conduction of heat from molten-metal in the ladle to the support.

6. A side-pouring apparatus according to claim 2, further comprising an inner frame on which the ladle and the support are mounted, an outer frame and a load cell through which said inner frame is suspended on said outer frame.

* * * * *